United States Patent [19]

Engle

[11] Patent Number: 4,947,761

[45] Date of Patent: Aug. 14, 1990

[54] STUB AXLE TRUCK

[75] Inventor: Thomas H. Engle, Cape Vincent, N.Y.

[73] Assignee: General Signal Corporation, Stamford, Conn.

[21] Appl. No.: 398,416

[22] Filed: Aug. 25, 1989

Related U.S. Application Data

[63] Continuation of Ser. No. 116,775, Nov. 5, 1987, Pat. No. 4,883,000, which is a continuation-in-part of Ser. No. 776,764, Sep. 16, 1985, abandoned, and a continuation-in-part of Ser. No. 853,562, Apr. 18, 1986, Pat. No. 4,718,351.

[51] Int. Cl.[5] ..... B61F 15/00; B61F 5/26; B61C 13/00

[52] U.S. Cl. ..... 105/4.4; 105/34.1; 105/221.1

[58] Field of Search ..... 105/4.4, 169, 34.1, 105/221.1

[56] References Cited

U.S. PATENT DOCUMENTS

| | | |
|---|---|---|
| 1,594,148 | 7/1926 | Buckwalter . |
| 2,047,248 | 7/1936 | Bachman . |
| 2,087,684 | 7/1937 | Alessi-Grimaldi . |
| 2,097,969 | 11/1937 | Edmunds et al. . |
| 2,539,387 | 1/1951 | Alden . |
| 2,746,398 | 5/1956 | Tomas . |
| 2,746,399 | 5/1956 | Tomas . |
| 2,843,057 | 7/1958 | Markestein et al. . |
| 2,899,911 | 8/1959 | Lich . |
| 3,161,250 | 12/1964 | Gardner . |
| 3,190,237 | 6/1965 | Hunter . |
| 4,331,210 | 5/1982 | Petrak . |

FOREIGN PATENT DOCUMENTS

| | | |
|---|---|---|
| 0050207 | 9/1981 | European Pat. Off. . |

*Primary Examiner*—Andres Kashnikow
*Assistant Examiner*—Virna Lissi Mojica
*Attorney, Agent, or Firm*—Barnes & Thornburg

[57] ABSTRACT

A truck having a pair of wheels mounted by individual stub axles to longitudinal members of a frame. Lateral members of the frame received the forces from the wheels via the longitudinal members and forces from the car via air springs mouted to the lateral members adjacent the longitudinal members. The stub axles are easily removed from U-shaped retainers. A sleeve through the hollow axle retains the bearings to the axle. Half shafts interconnects/a gear box and the stub axles for driven trucks and the interconnect are dimensioned to allow the shafts to be removed axially through the hollow axle.

16 Claims, 9 Drawing Sheets

STUB AXLE TRUCK

This application is a continuation of U.S. Ser. No. 116,775 filed Nov. 5, 1987, now U.S. Pat. No. 4,883,000, which is a continuation-in-part of U.S. Ser. No. 776,764 filed Sept. 16, 1985, now abandoned and a continuation-in-part of U.S. Ser. No. 853,562 filed Apr. 18, 1986 now U.S. Pat. No. 4,718,351 of which the following is a specification.

BACKGROUND AND SUMMARY OF THE INVENTION

The present invention relates generally to an improved train, and more specifically to an improved truck between the cars of integral trains and an intermodal integral train for transporting highway vehicles having their own wheels or other types of loads, without wheels, such as containers.

The designs of special cars to be used in a railroad system to carry containers or trucks or truck trailers have generally been modifications of existing railroad stock. These systems have not been designed to operate in the normal railway environment which imposes shock leads on the cars during switching and operating periods, and thus, have not taken advantage of the fact that these lighter loads could be designed for, if cars were never uncoupled for switching operations. The economy and operation of the lighter weight trains that could thus be designed, as well as economies in the cost of original material were not taken into account.

An integral train can be made up of a number of subtrains called elements. Each element consists of one or two power cabs (locomotives) and a fixed number of essentially permanently coupled cars. The cars and power cabs are tightly coupled together in order to reduce the normal slack between the cars. The reduction of the slack results in a corresponding reduction in the dynamic forces which the cars are required to withstand during the run in and out of the train slack. The reduction of the dynamic forces allows for the use of lighter cars, which allows for an increase in the cargo weight for a given overall train weight and therefore an increase in train efficiency occurs. Additional improvements in efficiency were to be obtained through the truck design and from other sources.

A complete train would consist of one or more elements. The elements could be rapidly and automatically connected together to form a single train. It is expected that in certain cases elements would be dispatched to pick up cargo and then brought together to form a single train. The cargo could then be transported to the destination and the elements separated. Each element could then deliver its cargo to the desired location. Each element would be able to function as a separate train or as a portion of a complete train. The complete train could be controlled from any element in the train. The most likely place for control would be the element at the head end of the train, but it is anticipated that in the case of a failure in the leading unit, the train could be controlled from a following element.

It is well known that when trains go around a sharp curve, the railroad truck must rotate relative to the body to allow the train to negotiate the curve. Various railroad truck constructions have been provided to allow this to happen. Similarly, articulated couplings have been provided between cars to help steer the railroad cars around the turns. These generally have included adjustable linkages connecting the cars to each other and laterally displaced to complimentarily elongate and contract. In some trains, a common railroad truck has been provided between adjacent cars which constitutes the articulated coupling. The cars are joined to the truck to pivot at a point along their longitudinal axis and rods are provided at both ends of the truck and connected to each of the cars such that the axle of the truck bisects the angle defined by the adjacent lateral axis of the adjacent cars.

The truck for railroad cars generally includes a single rotating axle and a pair of wheels, as shown in U.S. Pat. No. 2,746,399. Since the axle rotates with the pair of wheels, twisting forces are transmitted between the wheels. Loads placed on the axle outboard of the wheels results in bending stresses in the axle. When the axle rotates, planes of bending forces rotate through 360° at each rotation of the wheel. This subjects the outer surface of the axle to a full reverse stress cycle for each wheel revolution. This is the worst fatigue loading case and requires that the axle cross-section be round and quite heavy. At any given moment, most of the outer surface of the axle will carry stress far below the maximum stress, but will be subjected to the maximum stress at some time during the revolution of the wheel. Since wheels seldom have equal rolling radii at any two points, one wheel will tend to rotate slightly more or less than the other when a given distance is traversed. This sets up creep stresses both at the interface of the rail and wheel and at the axle. This creep is in addition to the stresses previously discussed and requires that the axle have even greater mass.

The construction of prior art trucks also requires that the trucks be removed before the wheels or axle can be replaced or maintained. This is not only inconvenient but very costly since it requires the car to be brought into a yard for maintenance.

Therefore, it is an object of the present invention to provide a lighter truck.

Another object of the present invention is to provide a truck in which the wheels are easily removed in the field.

An even further object of the present invention is to provide a truck wherein wheel wear is reduced.

Still a further object of the present invention is to provide a truck which reduces the cost of energy by reducing wheel creep.

An even further object of the present invention is to provide a truck having a better and more comfortable ride.

Still a further object of the invention is to provide a wheel and axle assembly which can be used as a driven or undriven wheel.

An still further object of the invention is to provide a wheel and axle assembly which allows maintenance of the wheel axle and its bearings in the field.

These and other objects are attained by providing a stub axle truck having a frame which carries the load between the car and the wheel instead of the axles. A pair of wheels are mounted to individual stub axles and each of the stub axles are rotatably mounted to the frame. Springs are mounted to portions of a lateral frame member extending beyond longitudinal frame members. This allows the movement in the truck lateral frames to be as low as possible, thus minimizing the cross-sectional dimension and weight of the load members. A pin is connected to and centered on the frame for rotatably connecting the frame to the longitudinal axis of the car.

The frame includes two lateral or transverse members with two pairs of longitudinal members connected at each end thereof. Inverted U-shaped openings in the longitudinal members receive the stub axles and bearings which rotatably mount the stub axles within the U-shaped openings. A retainer is provided at the bottom of each U-shaped opening for removably retaining the axle and limiting the axial movement of the bearings. This particular structure allows easy removal of the wheel, the stub axle and bearings in the field by merely raising the truck, removing a portion of the retainer which extends across the bottom open legs of the U-shaped opening and then dropping the wheel bearings and axle.

The stub-axle is hollow and includes a sleeve extending through it. A pair of radial flanges extend from each end of the sleeve for mounting the bearing to the axle. One of the radial flanges is removable to allow disassembly of the bearing from the axle. The removable radial flange and the sleeve include mating threaded surfaces. Axially extending and mating recesses and lugs are provided on the end of the axle and on the non-removal flange to interlock them to prevent rotational movement therebetween. The sleeve includes splines on its interior for mating with the splines of a drive shaft. Thus the axle can be used for driven and non-driven wheels using a sleeve.

In another embodiment, the rail flanges are mounted directly to the axle of the wheel to act as bearing retainers. They are removably secured thereto by fasteners. In a power driven stub axle a shaft traverses the axle and connects to the power train. On the outboard side, this axle is connected to the outboard radial flange so as to drive the axle through the outboard radial flange.

In a power driven stub axle truck, a gear box is connected to the pair of wheels by a pair of drive shafts. The center pin may be connected to the gear box versus the frame. The outer diameter of the coupling between the gear box and the drive shaft is smaller than the outside diameter of the coupling of the drive shaft and the sleeve. This allows removal of the drive shaft axially through the axle without removing the axle from the frame. A cap on the end of the axle seals the connection of the sleeve and the drive shaft and includes a structure biasing the drive shaft towards the gear box. A biased seal is provided on the sleeve on the other side of the connection of the drive shaft to the sleeve. Also a biased seal is provided on the drive shaft to seal the connection of the drive shaft to the gear box. The outside diameter of the coupling at the gear end of the drive shaft and the sealing on the drive shaft is smaller than the inside diameter of the sealing on the sleeve.

The use of a spline connection between the drive shaft and the gear and the axle allows for deflection. The pin connecting the gear box or frame to the car body increases the stability and transferring of loads between the frame and the body and removes the requirement for lateral stops of the wheels relative to the frame.

Other objects, advantages and novel features of the present invention will become apparent from the following detailed description of the invention when considered in conjunction with the accompanying drawings.

DETAILED DESCRIPTION OF THE DRAWINGS

Figures 1, 2:
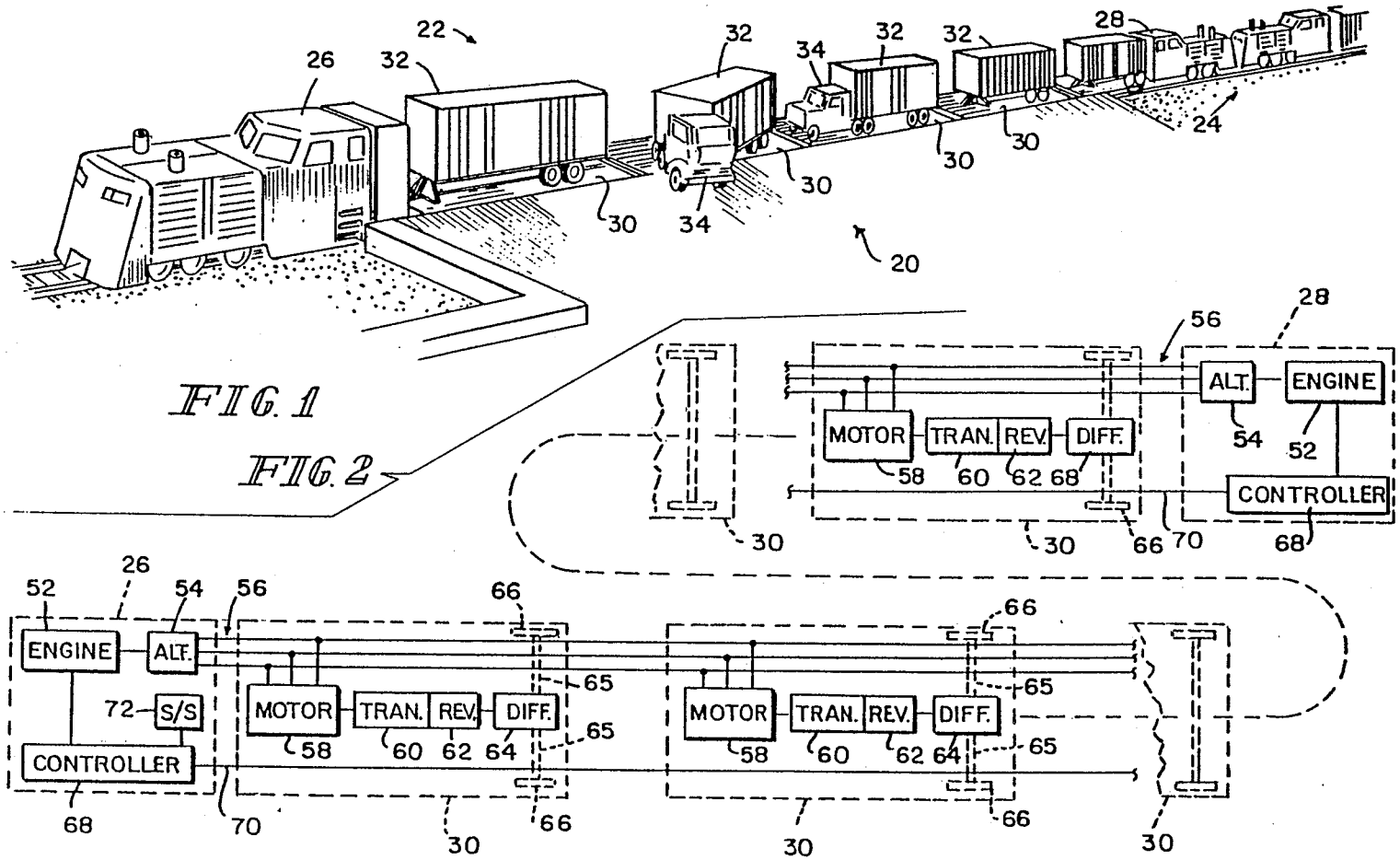
FIG. 1 is a perspective view of an integral train incorporating the principles of the present invention.
FIG. 2 is a block diagram of a propulsion system incorporating the principles of the present invention.

As illustrated in FIG. 1, a train 20 includes a plurality of train sections 22 and 24 which represent one of a plurality of train sections. Each section includes a pair of control cabs 26 and 28 at each end of the section. Note that conventional locomotives could be used at these locations. As will be explained in more detail below, one of the control cabs has controls set to "LEAD" and will accept commands from an operator, while the other has its controls set to "TRAIL" and the controls are interconnected to provide the appropriate control of the propulsion and braking system. Connected between the two control cabs 26 and 28 is a plurality of cars 30 forming a continuous deck. The deck is structured such that loads, for example trailers 32, may be secured to the cars 30 on a specific car or across the juncture of a pair of cars. The trailers 32 may be secured by themselves or in combination with the tractors 34. By providing a continuous decking, the train 20 can be side loaded from a flush platform. This allows simultaneous loading of trucks, thus eliminating the necessity to wait for a loading crane, or for a truck occupying a different position to be loaded.

The control cabs 26 and 28 need not be locomotives in the conventional sense. The propulsion system 50 is considered a distributive propulsion system as illustrated in FIG. 2. The control cabs 26 and 28 include a mechanical engine 52 driving an electrical alternator 54. The output of the alternator 54 is three phase current whose frequency and voltage are a function of the speed of the engine 52. This current is transmitted down a three phase wire system 56 to a plurality of electric motors 58 distributed throughout the cars 30. Each of the electric motors 58 are connected to a respective automotive-type automatic transmission 60 with fluid coupling which includes a directional control reversing gear 62. The output of the directional control reversing gear drives a differential 64 to which a pair of axles 65 and wheels 66 are connected. Each of the control cabs 26 and 28 include a controller 68 which can control the speed of all of the engines based on a throttle setting selected by the operator in one cab. The controller 68 also provides control signals via line 70 to the transmission 60 and the reversing gear 62. A train speed sensor 72 on a non-powered axle provides an input signal to controller 68. The controller 68 selects the gears of the transmission and the shift points as a function of the measured speed of the train and the throttle setting.

For a 1,050 foot train element of approximately 42 cars, the five cars 30 adjacent to each of the control cabs 26 and 28 include the motor, transmission, reversing gear and differential.

Figure 3:
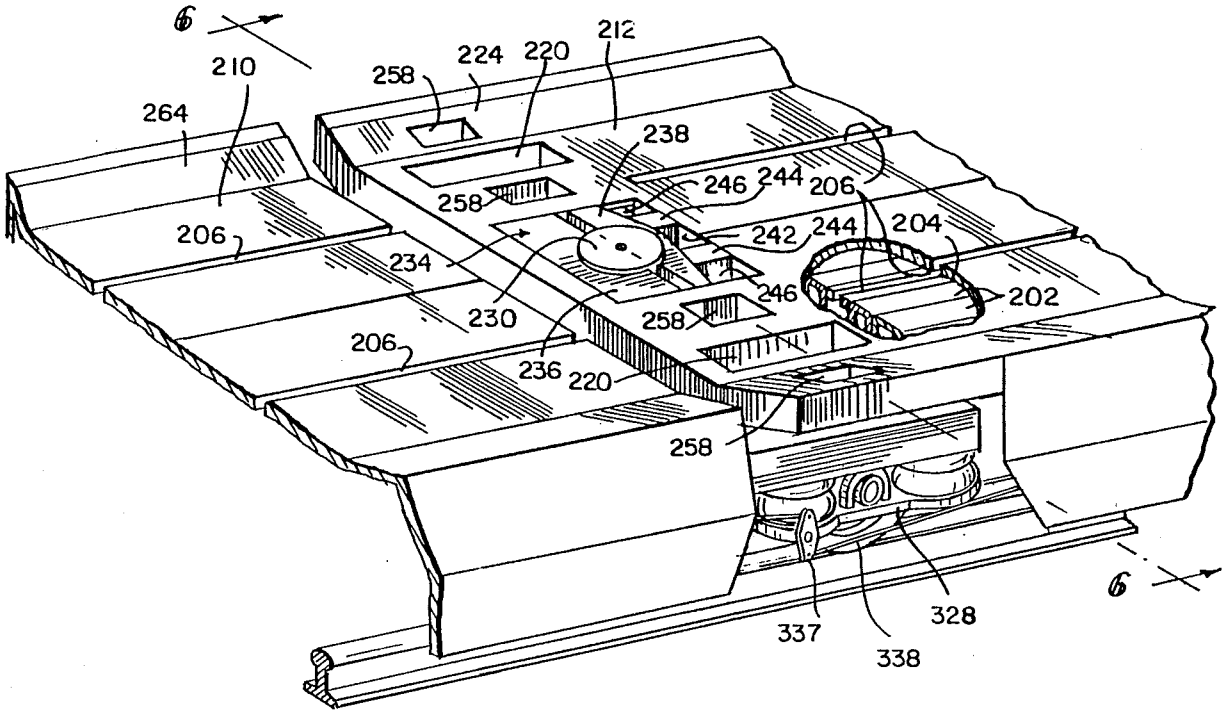
FIG. 3 is a perspective view of a coupled pair of cars incorporating the principles of the present invention.
Figure 4:
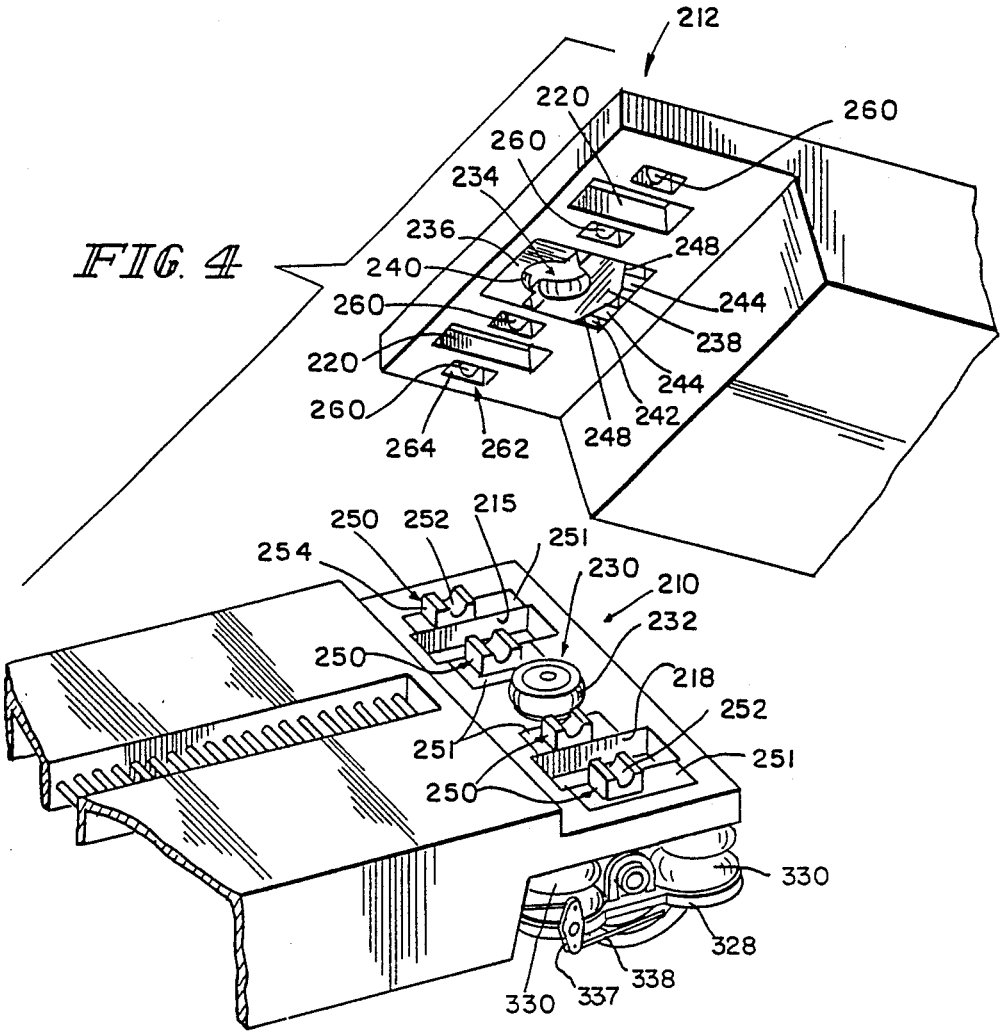
FIG. 4 is an exploded perspective view of an articulated coupling incorporating the principles of the present invention.

The car 30, as illustrated in FIG. 3, has a wheeled end 210 and a wheelless end 212. Thus, each car only has a single stub axle truck and is supported at its wheelless end 212 by the truck of the adjacent car. The end structure which extends over the wheels at the wheeled end 210 includes an end under frame that is constructed and welded to the main frame. The wheelless end 212 also includes an underframe which is welded to the main frame. The wheelless end 212 overlaps the wheeled end 210 to form a continuous platform. Mating elements in the overlapping end structure form an articulated coupling which is slack-free and self-compensating for wear. The deck and frame at the wheeled end 210 has a pair of recesses 218 to receive wheels 66. Wheelless end 212 includes a corresponding pair of recesses 220.

The details of articulated couplings, which allows or facilitates the accommodation of yaw and pitch while limiting roll, is illustrated specifically in FIGS. 3, 4, 6 and 7. A center coupling includes a male member 230 having convex surface 232 which is a section of a sphere, mounted at the longitudinal axis of car 30 at the wheeled end 210 to define a vertical axis of rotation. The radius of 232 is selected as large as possible to reduce the stress of the coupling. The female member 234 of the center coupling includes two half collars 236 and 238, each having a concave surface 240 which complements the convex surface 232 of the female member in a recess 242 of the wheelless end 212. Whereas collar 236 is fixed to the frame, collar 238 moves along the longitudinal axis of the body in a track in the recess 242. A pair of wedges 244 are biased laterally by spring 246 to engage rear surface 248 of the movable collar 238 to bias it longitudinally toward fixed collar 236. The angle of the wedge is in the range of 4½ to 9 degrees from the lateral axis to control the mechanical advantage of springs. Thus the springs bind the half collar from opening when the forces produced by slack action are imposed, but do not close it so tight as to cause excessive wear. The springs also compensate for wear.

The four side bearings include a male member 250 having a concave surface 252 and lateral faces 254. The female member 258 of the side bearings includes a cylindrical member 260 mounted between the lateral faces 264 of recess 262 of the wheelless side 212 of the adjacent car. The four female cylindrical members 260 are coaxial with each other and at the center of the sphere of the center coupling 230 to define the lateral axis about which the couplings rotate. The male members 250, which move relative to the top surface of the wheeled end 210, have bearing surfaces therebetween to facilitate the relative movement. At a minimum, the top surface of the wheeled end 210 is treated with a material or wear plate to reduce the friction in the anticipated arcuate path of the male members 250. A plate 251 is illustrated as mounted to the surface of wheeled end 210.

Figure 5:
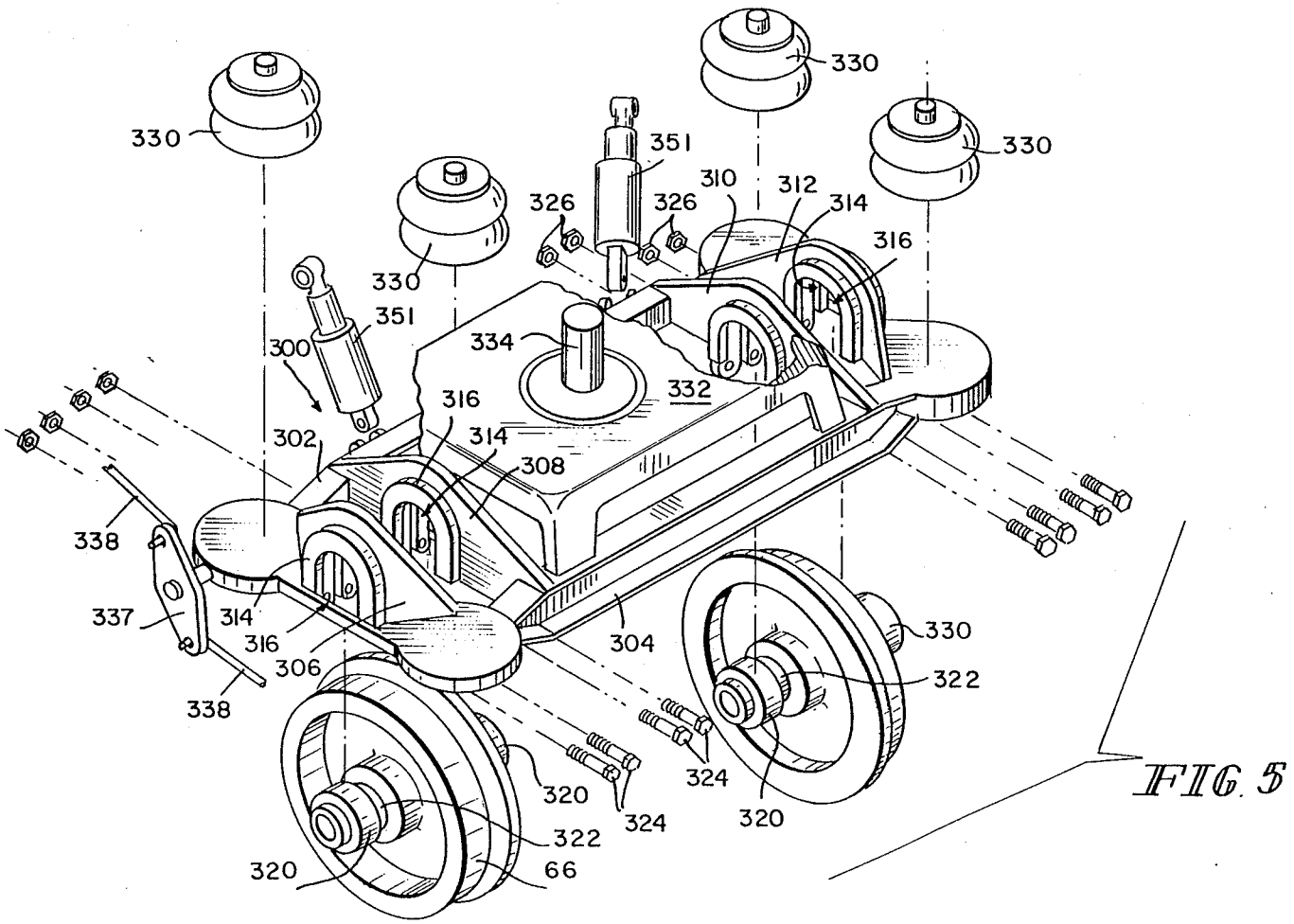
FIG. 5 is an exploded perspective view of a non-driven stub axle truck assembly incorporating the principles of the present invention.
Figure 6:
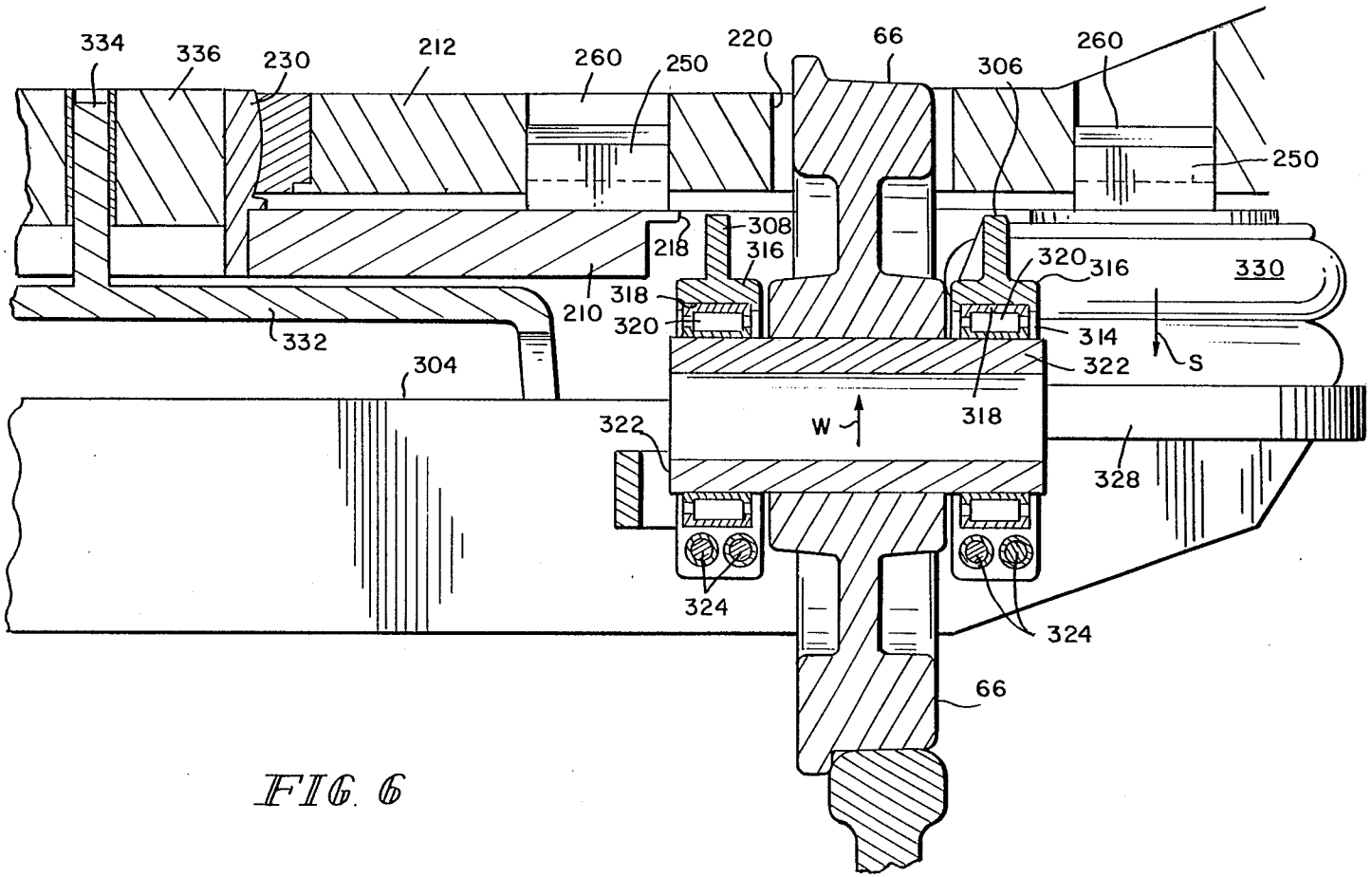
FIG. 6 is a cross sectional view taken along the lines VI—VI of FIG. 3 showing the articulated coupling and the truck.
Figure 7:
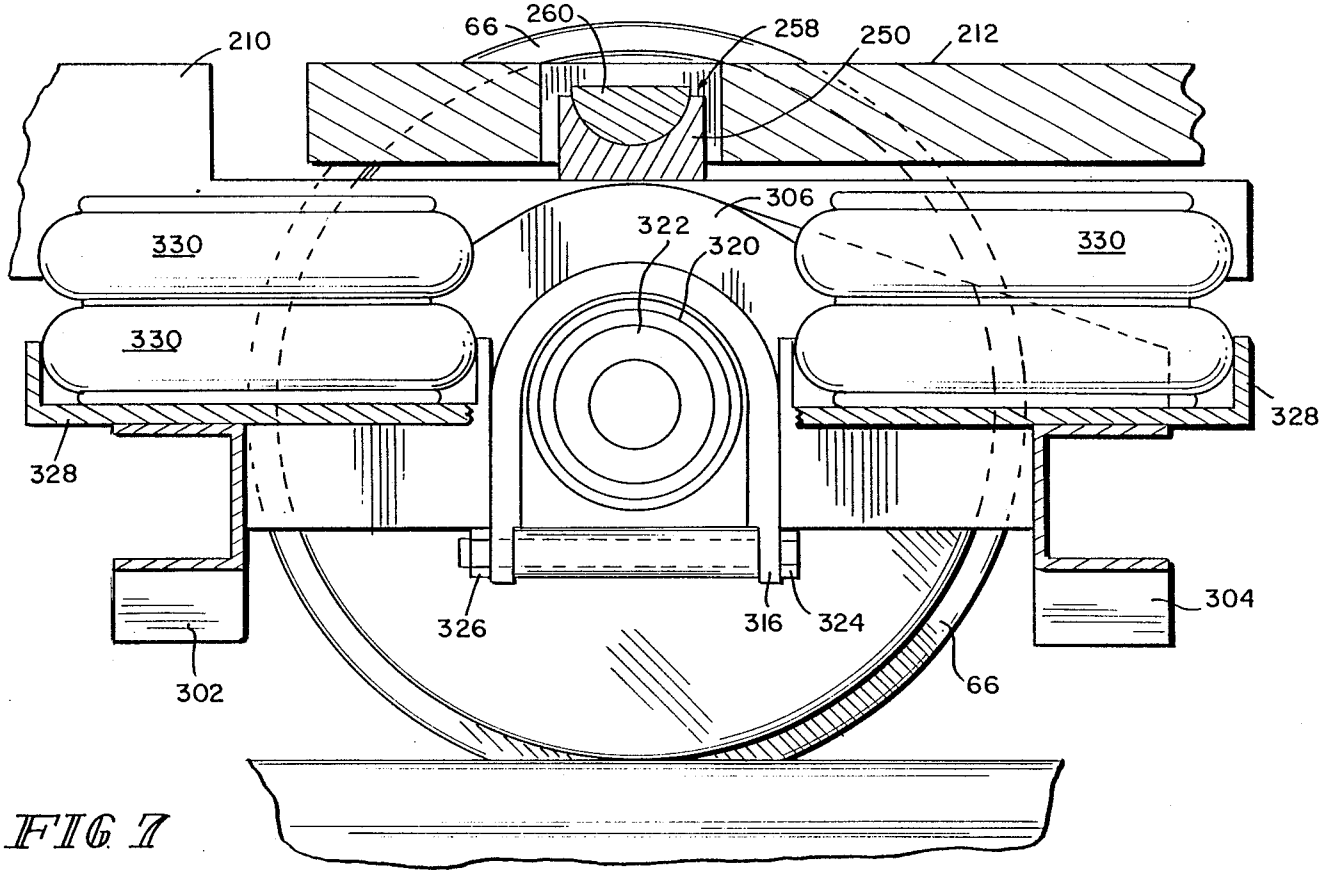
FIG. 7 is a partial cut-away side view of FIG. 3 showing the articulated coupling and the truck.
Figure 8:
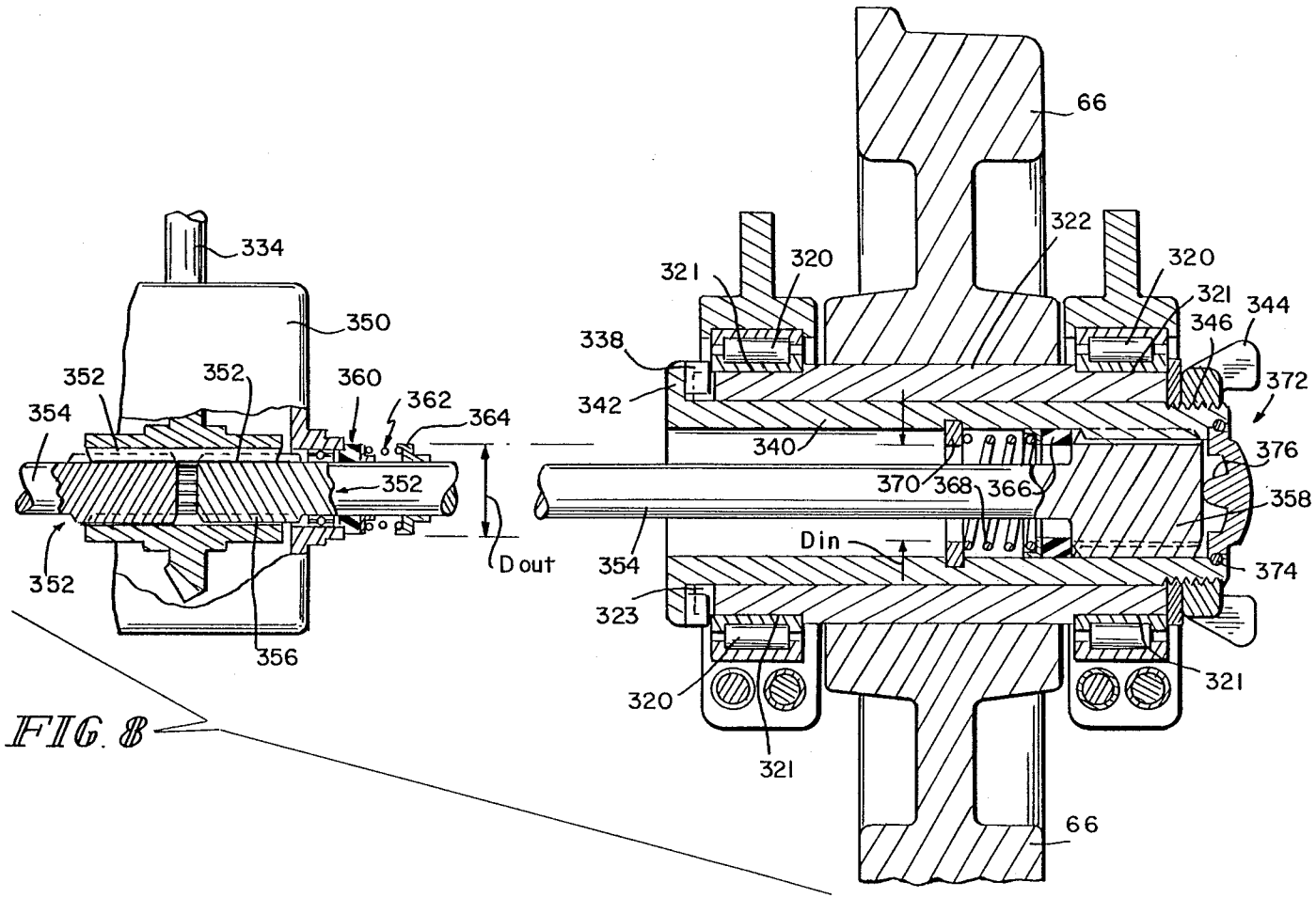
FIG. 8 is a partial cut-away view of the coupling of the gear box, drive shaft and the stub axle.

A stub axle truck provided for the articulated coupling is illustrated in detail in FIGS. 5, 6 and 7 is adapted for a powered axle in FIG. 8. A frame 300 includes two lateral members 302 and 304 and two pairs of spaced longitudinal members 306, 308 and 310, 312 at the ends of the lateral members 302, 304. It should be noted that the reference to lateral and longitudinal is with respect to the car body to which the truck is mounted. Each of the longitudinal members 306, 308, 310, 312 includes an inverted U-shaped opening 314 having its open end at the bottom. A retainer 316 about the U-shaped opening extends traverse to both sides of the longitudinal members.

A groove 318 is provided in the surface of the U-shaped retainer 316 and receives the bearing 320 mounted to the stub axle 322 of wheel 66 as illustrated in detail in FIG. 6. One or more fasteners 324 having a nut 326 extend across the bottom of the U-shaped opening 314 and retains the bearing axle assembly within the U-shaped opening and limits vertical displacement. The groove 318 limits the axle motion of the bearings 320. It should be noted that the fasteners 324 are generally not needed for the truck in normal use since the weight of the truck and car will load the frame 300 down on to the axle 322. Fasteners 324 are used to prevent the wheel and axle from coming off the frame 300 during derailing.

The specific mounting and retaining structure of the stub axle allows ease of assembly and disassembly of the wheel, axle and bearing to the truck without bringing the car into a rail yard. To be more specific, a jack is provided under the frame 300 to raise it to the height of the wheel. The fasteners 324 are moved and the wheel-axle-bearing assembly is moved vertically down from the retainer 316 and tilted to allow the flange of wheel 66 to clear the tracks. A new wheel-axle-bearing assembly is inserted in the retaining 316, the truck frame is lowered on to the axle and fasteners 324 are inserted through the opposing walls of the retainer 316 and secured thereto by nuts 326.

Although the walls of the U-shaped opening 316 have been shown as substantially parallel, they may diverge towards the bottom with the radius at the top of bite of the U-shaped being sufficient to capture the bearing 320.

A spring platform 328 is provided on an extended portion of each of the lateral frame members 302 and 304 which extends beyond the pairs of longitudinal members 306, 308 and 310, 312. Four air springs 330 are provided between the spring platform 328 and the car frame as is specifically illustrated in FIGS. 6 and 7. A center pin support plate 332 is connected to the lateral members 302, 304 of the frame. A pin 334 is centered on the frame and is connected to an elastomeric bushing 336 of the center coupling 330 along the center longitudinal axis of the car body. The use of the center pin 334 increases stability in transferring the loads between the truck and the body and removes the requirement of any lateral stops. Sufficient space is left beneath support plate 332 to install a right angle drive or differential. Thus, all trucks, both powered and non-powered, use the identical truck frame and structure.

A pair of links 337 are connected to the end of lateral frame member 302 adjacent spring platform 328. Steering levers 338 connect the links 337 and the two adjacent cars. Although two links 337 and pairs of steering levers 338 for each link are shown, a single group may be used since the pin 334 defines a point at which the steering can be transmitted to the other end of the frame. As the car rounds a curve, the truck always takes a position bisecting the angle made by the two adjacent cars.

The entire truck frame 300 is free to swivel beneath the car, within the constraints provided by the center pin 334 and steering linkage 338. Such swivelling produces longitudinal displacement of the wheels as the car rounds a curve, and this is accepted by the air springs 330 being longitudinally deflected. Thus, vertical suspension and axle swivel freedom are both provided by the air springs 330. Lateral loads from the rail are transmitted to the car, both through the air springs 330 and center pin 334 into the rubber bushing 336 in the center of the articulated joint which acts as an elastomeric lateral stop.

A pair of shock absorbers 331 are also provided between the frame 300 and the body of the car. The shock absorbers may be connected at an angle to provide shock absorption for up-down as well as lateral motion.

The mounting of the wheels 66 on individual axle 322 to the frame 330 reduces the wheel creep force which exists on wheels mounted to a common axle. This increases the efficiency of the system since 15% of the total force lost is due to wheel creep. Similarly, it reduces the wear on the wheels and makes them last longer.

By mounting the individual wheel 66 and axle 322 to longitudinal frame members, the load of the wheels is transmitted via the longitudinal frame members to the lateral frame members 302 and 304. The mounting of the springs 330 on the lateral members 302 and 304 also transmit the forces of the body of the car to the lateral members 302, 304. Thus the forces are all absorbed and transmitted through the lateral members 302 and 304. This reduces the loads on the wheel axle and longitudinal members. Therefore, the axle and longitudinal members may be reduced in size and weight. In prior art structures, the axle carries all the load from the wheel and the body. Since the axle also rotates, it has to be of uniform thickness and thick enough to absorb the load and the rotation. By using the lateral members 302, 304 for accumulation of the load, the axles and longitudinal members can be made lighter.

As illustrated in FIG. 6, the weight of the body through the air spring 330 is represented by the arrow S and the forces produced from the truck through the wheel is indicated by the arrow W. These arrows are the effective center of the forces along the lateral members 302, 304. The distance between them is approximately 12 inches thereby minimizing the moment produced by these force relative to each other. Thus, even the lateral frame 302, 304 may be lighter since the moment is reduced. Lighter frame members and axle reduce the dynamic forces within the frame since dynamic forces are proportional to the mass. This extends the life of the wheels and bearings.

The stub axle truck of FIGS. 5–7 has been illustrated using a non-driven axle, and may be used as a driven axle as illustrated in FIG. 8. The power driven wheel includes the axle 322 having a shoulders 321 therein to receive the bearings 320. A sleeve 340 extends through the hollow stub axle 322 and includes a radial flange 342 at one end and a removal radial flanges 344 secured at the other end by mating threaded surfaces 346. Axial recesses 323 on the face of the axle 322 receive axial lugs 348 on the adjacent face of the radial flange 342 so as to lock the sleeve 340 to the axle 322 to prevent rotational movement therebetween. A plurality of lug/recesses are provided around the circumference cf the axle and sleeve. For example, four such combinations are provided.

To replace and service the bearings, the removable flange 344 is removed and the sleeve 340 is removed axially. This will release the bearings 320 such that they can be replaced. Although the sleeve acting as a bearing retainer has been described specifically in FIG. 8 with respect to a driven axle, the sleeve may also be used to retain the bearings in a non-driven axle configuration.

The power input is received by the gear box 64 and provided at a pair of outputs 352. The gear box 64 is a right angle drive including differential outputs and is mounted to the truck. The pin 334 may be provided connecting the gear box to the car body in which case the support plate 332 would be eliminated from the frame. A pair of half-drive shafts 354 are connected at a first spline end 356 to gear box output 352 and at a second spline end 358 to the sleeve 340 of the axle 322.

A sealing ring 360 is provided on the half-shaft 354 adjacent spline end 356 and is biased by spring 362 from stop 364 to seal the connection between the drive shaft 354 and the output 352 of the gear box. On the interior of the sleeve 340 is a sealing ring 366 which is biased by spring 368 relative to stop 370 to seal one side of the spline connection 358 of the half-shaft 354 to the sleeve 340. A cap 372 covers the end of the sleeve 340 and is retained thereto by retaining ring 374. A protrusion 376 from the cap 372 biases the half-shaft 354 towards the gear box 350.

The diameter of the portions of the power axle interconnection are selected such that the half-shaft 354 can be removed from the cap side to allow maintenance without axle removal and permit removal of the gearbox, or its isolation from the wheel in the event of gearbox failure while under way. The outside diameter D-out of seal 360, 362, 364 and the spline 356 is smaller than the inside diameter Din of the seal 366, 368, 370 and splines 358 such that the end 356 and the seal 360, 362, 364 may be removed through the axle, namely to the right as illustrated in FIG. 8. The end cap 372 may be removed and the half-shaft slid out through the axle 322 and the sleeve 340.

Figure 9:
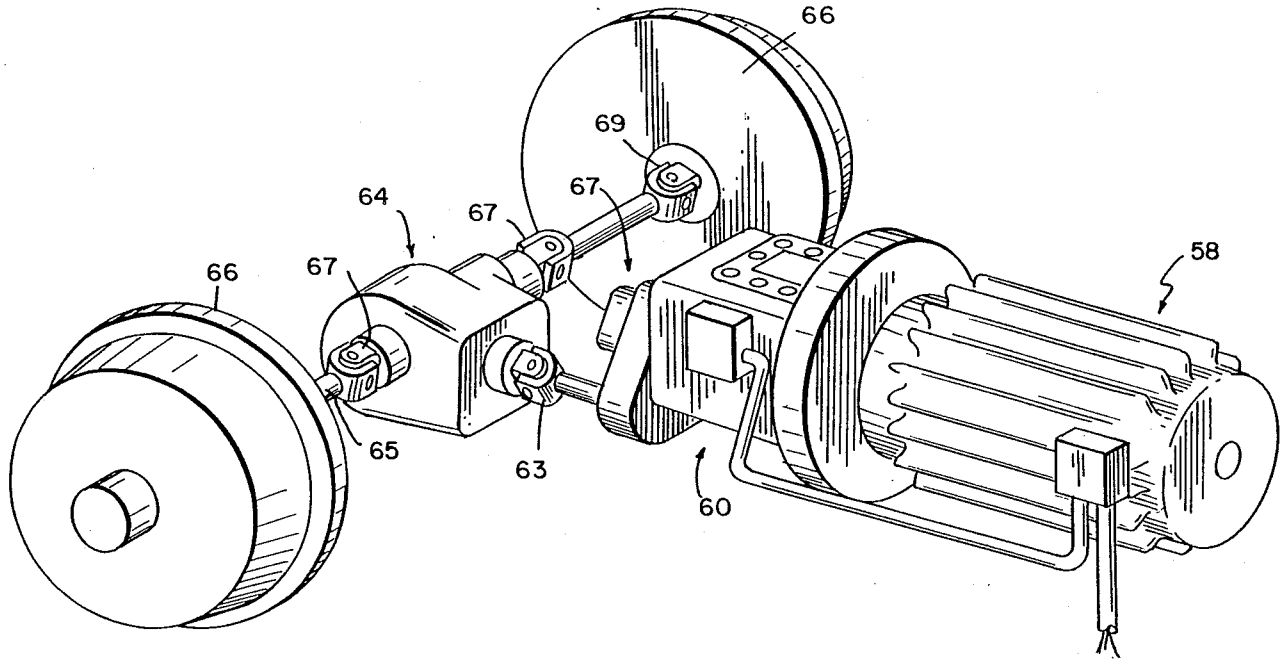
FIG. 9 is a perspective view of another coupling of the power input to the gear box, and drive shaft and stub axle.

An alternative connection of the power input is illustrated in FIG. 9. The electric motor 58, automotive automatic transmission 60 and direction control reversing gear 62 as a unit are mounted to the truck. The right angle gear box 64 receives the output of the reversing gear through a universal joint 63 and provides outputs at right angle to the inputs to the individual axle 65 and wheels 66 via U-joints 67 and 69.

Figure 10:
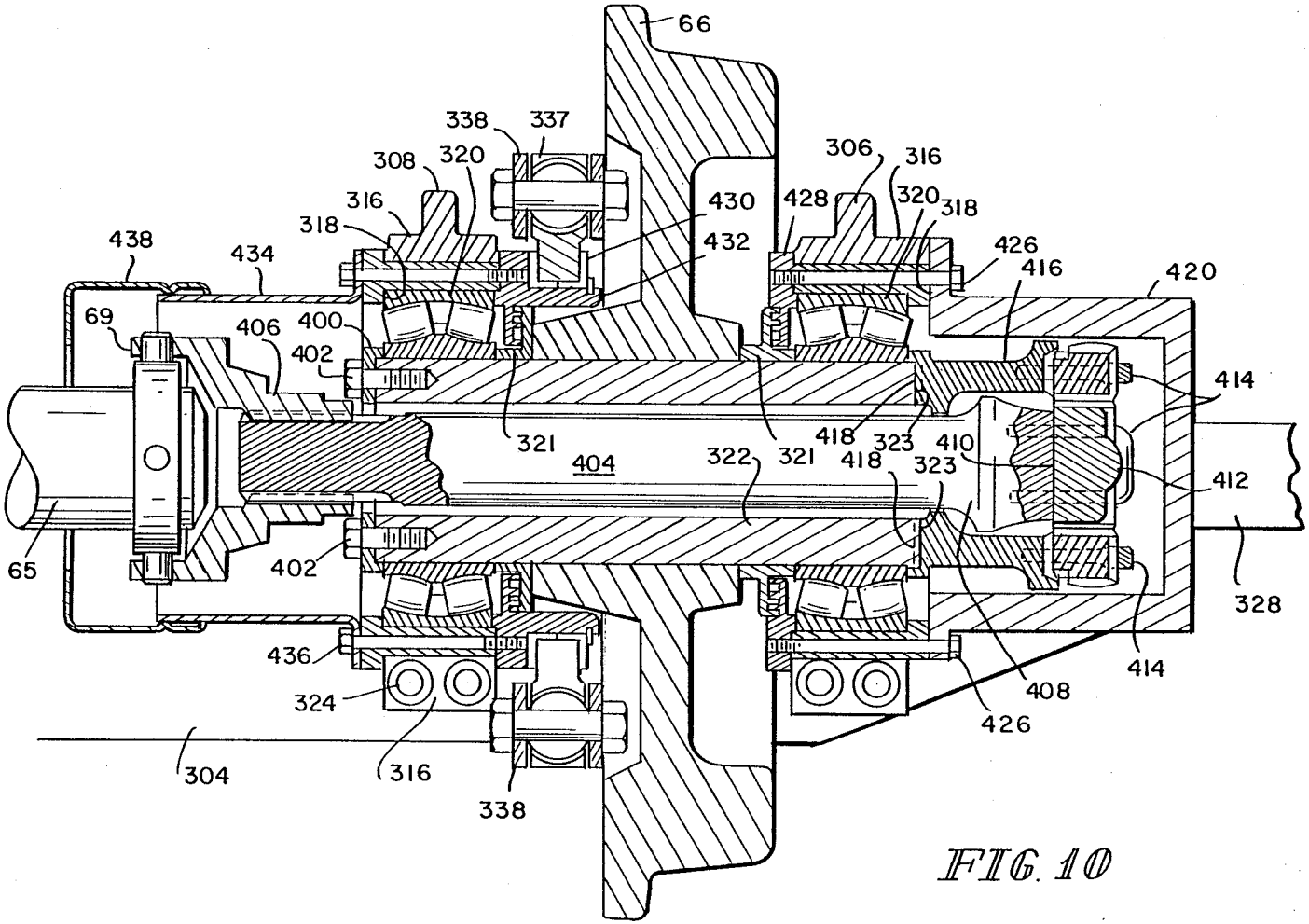
FIG. 10 is a partial cut away view of another embodiment of the mounting of the steering linkage, wheel and axle to the truck.

Another embodiment for mounting the wheels 66 to the truck frame and the steering links 337 is illustrated in FIG. 10. As in the previous figures, the wheels 66 include a stub axle 322 with bearings 320 mounting the stub axle to the U-shaped retainer 316. A shoulder 321 on the axle 322 forms a stop for one side of the inner race of the bearing 320. It should be noted that the elements which have common configuration and function as in the other embodiments are given the same reference numerals in FIG. 10 as in the other embodiments illustrated.

The other side of the bottom race of the inboard bearing 320 is retained by an annular radial flange 400 mounted to the stub axle 322 by fasteners 402. A shaft 404 extends through the center of the hollow axle 322 and includes splines 406 at its inboard end to the universal joint 69. The outboard end 408 of the shaft 404 is connected to an outer half 410 of a universal joint. The inner half 416 of the universal joint is mechanically connected in the outer half 410 by a t-shaped pin or bearing 412. U bolts 414 retains the pin 412 to the U-joint halves 410 and 416. The outer U-joint half 416 is connected to the axle 322 at axial lugs 418 received in axial recesses 323 of the axle 322. The outer U-joint half 416 forms the outboard stop for the bottom of the outboard bearing 320. Rotation of the shaft 404 is transmitted to the axle 322 via 410, 412 and 416. Because of the cross-section shown, the fasteners which join the outer U-joint half 416 to the axle 322 and a majority of the inner U-joint half 410 are not shown. As in the previous embodiments, the outside diameter of the inboard end of shaft 404 is smaller than the outboard end 408 for easy removal. It should be noted that the use of three universal joints between gear box 64 and wheel 66 isolate their stresses and motions from each other.

A cover 420 is connected to the longitudinal members 306 via a fastener 426 extending through the outboard retainer 316 and being received in a threaded opening of an annular plate 428 which forms a removable wall of the recess 318. Removable cover 420 provides access to the fasteners of and elements 410, 412, 414 and 416 of the U-joint to allow removal thereof from the outboard side such that they and the shaft 404 can be removed axially. Once they are removed, the wheels 66 and its stub axle 322 can be removed vertically by removing fasteners 324 as in the other embodiment.

As another variation on the previously disclosed embodiments, the steering links 337 and the levers 338 are mounted inboard the wheel versus outboard as shown in the other embodiments. A bearing 430 mounts the steering links 337 to an annular retainer 432. A cover 434 for the U-joint 69 is mounted to the retainer 316 of longitudinal frame member 308 by fastener 436 extending thereto and being received in a threaded opening in the annular retainer 432. A cap 438 is snapped on cover 434 and has a central opening to allow connecting of shaft 65 to the U-joint 69.

As with the previous embodiments, the radial flange 400 and the outer half 416 of the U-joint are mounted to the axle 322 in the powered or unpowered axle since they are bearing retainers.

Although the stub axle truck has been shown with a pair of wheels on aligned stub axles, the truck in the present invention may also be a four-wheel truck. Two longitudinally spaced wheels and axle combinations would be provided extending between each pair of longitudinal members 306, 308 and 310 312.

From the preceding description of the preferred embodiments, it is evident that the objects of the invention are attained, and although the invention has been described and illustrated in detail in connection with an intermodal integral train, they are equally applicable to other integral trains and even non-integral trains. It is to be clearly understood that the same is by way of illustration and example only and is not to be taken by way of limitation. The spirit and scope of the invention are to be limited only by the terms of the appended claims.

What is claimed:

1. A stub axle truck comprising:

a truck frame;

two pairs of opposed inverted U-shaped openings on said frame, each U-shaped opening having an open end;

a pair of wheels each being mounted to a hollow stub axle;

each axle traversing a pair of U-shaped openings;

a bearing means including an inner and outer bearing member mounted on said stub axle to form a unit for rotatably connecting a respective end of a stub axle to a respective U-shaped opening;

steering means mounted on said stub axle as part of said unit for connecting a steering link to said wheel; and a removable fastener extending across said open-end of said opening for removably retaining said axle, steering means and bearing means in a respective U-shaped opening and allowing removal of said axles, steering means and bearing means as a unit along an axis transverse to the axis of said stub axle.

2. A truck according to claim 1, including a U-shaped groove in said-U-shaped openings for retaining said bearing means against axial movement.

3. A truck according to claim 1, wherein:

said axle includes a sleeve extending through said hollow of said axle;

a radial flange extending from each end of said sleeve adjacent an end of said axle for mounting said bearing means to said axle;

one of said radial flange being removable mounted to said sleeve.

4. A truck according to claim 1 wherein:

said frame includes a pair of spaced lateral members and two pairs of spaced longitudinal members extending between said lateral members at each end thereof, and said wheels are between a respective pair of longitudinal members with its axle extending through a U-shaped opening in a longitudinal member.

5. A truck according to claim 4, including spring means mounted to said lateral members of said frame for supporting a car on said truck.

6. A truck according to claim 5, wherein said lateral members include a portion which extends beyond said longitudinal members and said spring means are mounted on said extended portions of said lateral members.

7. A truck according to claim 5, including a pin means connected to and centered on said lateral members for rotatably connecting said frame to the longitudinal axis of a car.

8. A truck according to claim 1, including coupling means on said stub axle for drivingly coupling a drive shaft to said stub axle.

9. A stub axle truck comprising:

a frame;

a pair of wheels each being mounted to a hollow stub axle;

bearing means including an inner and outer bearing member mounted on said stub axle to form a unit for rotatably mounting each end of said axle to said frame;

steering means mounted on said stub axle as part of said unit for connecting a steering link to said wheel; and retaining means on said frame for removably retaining said axle, steering means and bearing means fixed axially to said frame and permitting removal of said axle, steering means and bearing means as a unit along an axis transverse to the axis of said stub axle.

10. A truck according to claim 9, including coupling means on said stub axle for drivingly coupling a drive shaft to said stub axle.

11. A truck according to claim 10, wherein said coupling means couples said drive shaft to an outboard side of said stub axle.

12. A truck according to claim 9, wherein said outer bearing member is maintained fixed to said frame by said retaining means and said inner bearing member rotates with said stub axle.

13. A truck according to claim 12, including rollers between said inner and outer bearing members.

14. A rail wheel assembly to be mounted and removed as a unit to a truck comprising:

a wheel mounted to a hollow stub axle;

bearing means including inner and outer bearing members mounted on said stub axle as a unit with the inner bearing member fixed to said stub axle to rotate therewith; and steering means mounted to said outer bearing member on said stub axle as part of said unit for connecting a steering link to said wheel wherein said wheel stub axle, bearing means and steering means are removable as a unit.

15. A rail wheel assembly according to claim 14 including coupling means on said stub axle for drivingly coupling a drive shaft to said stub axle.

16. A rail wheel assembly according to claim 15, wherein said coupling means couples said drive shaft to an outboard side of said stub axle.

* * * * *